US006431150B1

(12) United States Patent
Pearlman et al.

(10) Patent No.: US 6,431,150 B1
(45) Date of Patent: Aug. 13, 2002

(54) FUEL SYSTEM

(75) Inventors: Samuel Pearlman, West Bloomfield; Jared J. Keyes, Madison Heights, both of MI (US)

(73) Assignee: Detroit Diesel Corporation, Detroit, MI (US)

( * ) Notice: Subject to any disclaimer, the term of this patent is extended or adjusted under 35 U.S.C. 154(b) by 0 days.

(21) Appl. No.: 09/659,985

(22) Filed: Sep. 12, 2000

(51) Int. Cl.[7] ..... F02M 37/04
(52) U.S. Cl. ..... 123/468; 123/470
(58) Field of Search ..... 123/468, 469, 123/470

(56) References Cited

U.S. PATENT DOCUMENTS

| | | | | | |
|---|---|---|---|---|---|
| 3,845,748 | A | * | 11/1974 | Eisenberg | 123/470 |
| 4,312,479 | A | | 1/1982 | Tolan | |
| 4,384,557 | A | * | 5/1983 | Johnson | 123/468 |
| 4,445,713 | A | * | 5/1984 | Bruuning | 123/469 |
| 4,485,790 | A | * | 12/1984 | Nishimura | 123/468 |
| 4,705,306 | A | * | 11/1987 | Guido et al. | 123/469 |
| 4,790,055 | A | | 12/1988 | Raufeisen et al. | |
| 4,881,763 | A | * | 11/1989 | Guido et al. | 123/469 |
| 4,894,900 | A | | 1/1990 | Raufeisen et al. | |
| 4,938,193 | A | | 7/1990 | Raufeisen et al. | |
| 5,299,540 | A | | 4/1994 | Fransson et al. | |
| 5,365,907 | A | * | 11/1994 | Dietrich et al. | 123/470 |
| 5,515,829 | A | | 5/1996 | Wear et al. | |
| 5,617,828 | A | * | 4/1997 | Kuegel et al. | 123/468 |
| 5,757,259 | A | | 5/1998 | Fulford et al. | |
| 5,775,303 | A | | 7/1998 | Sweetland et al. | |
| 5,983,863 | A | | 11/1999 | Cavanagh et al. | |
| 6,176,221 | B1 | * | 1/2001 | Hofmann | 123/470 |
| 6,182,638 | B1 | * | 2/2001 | Breitenberger | 123/468 |
| 6,234,413 | B1 | * | 4/2001 | Greaney | 123/470 |
| 6,279,540 | B1 | * | 8/2001 | Greaney et al. | 123/470 |

* cited by examiner

*Primary Examiner*—Thomas N. Moulis

(57) ABSTRACT

A fuel system is provided for supplying fuel to a fuel injector associated with a cylinder head, wherein the fuel injector has an opening and the cylinder head has a bore. The fuel system includes a fuel pipe disposable in the bore of the cylinder head and including a pipe body having first and second ends. The first end is engageable with the fuel injector and alignable with the opening. The fuel system further includes a fuel line assembly including a fuel line having an end that is engageable with the second end of the pipe body. The assembly further includes a rotatable nut engageable with the fuel line and threadingly engageable with the cylinder head for urging the end of the fuel line into engagement with the second end of the pipe body to thereby urge the first end of the pipe body into engagement with the fuel injector.

13 Claims, 3 Drawing Sheets

14
26
12
16
2
2
10
16

60
48
52
54
50
46
68
56
25
58
24
38
34
22
44
37
72
64
74
62

FUEL SYSTEM

TECHNICAL FIELD

The invention relates to an improved fuel system for supplying fuel to an engine.

BACKGROUND ART

A prior fuel system for supplying fuel to a fuel injector of an engine includes a tapered fuel pipe that extends into a bore in a cylinder head of the engine. The fuel pipe mates with an opening in the fuel injector, and is secured to the engine with a first nut that engages the cylinder head. The fuel system also includes a fuel line that is connected to a threaded end of the fuel pipe with a second nut. Because each nut is tightened to a different torque level, the fuel system is relatively difficult to install.

In addition, because the first nut applies a force about the circumference of the fuel pipe, and because the fuel pipe is tapered, the fuel pipe may tilt or deflect within the bore in the cylinder head. As a result, misalignment between the fuel pipe and the opening in the fuel injector may occur, thereby causing potential loss of fuel pressure to the engine.

DISCLOSURE OF INVENTION

The invention addresses the shortcomings of the prior art by providing an improved fuel system that is easy to install and service. Furthermore, the fuel system may be configured to be self-aligning.

Under the invention, a fuel system is provided for supplying fuel to a fuel injector associated with a cylinder head, wherein the fuel injector has an opening and the cylinder head has a bore. The fuel system includes a fuel pipe disposable in the bore of the cylinder head and including a pipe body having first and second ends. The first end is engageable with the fuel injector and alignable with the opening. The fuel system further includes a fuel line assembly including a fuel line having an end that is engageable with the second end of the pipe body. The assembly further includes a rotatable nut engageable with the fuel line and threadingly engageable with the cylinder head for urging the end of the fuel line into engagement with the second end of the pipe body to thereby urge the first end of the pipe body into engagement with the fuel injector.

Because the nut connects the fuel line to the fuel pipe, and further connects the fuel system to the engine, the fuel system is significantly easier to install than prior fuel systems.

The second end of the pipe body preferably includes a radially-extending surface, and the end of the fuel line is preferably engageable with the radially-extending surface so as to urge the first end of the pipe body into engagement with the fuel injector. With such a configuration, the fuel line applies a force on the pipe body proximate an axis of the pipe body. Therefore, undesirable tilting of the pipe body can be effectively eliminated.

Furthermore, the pipe body is preferably provided with a constant diameter along a major portion of the pipe body. Such a configuration further inhibits tilting of the pipe body as the pipe body moves along the bore, and enables the pipe body to be self-aligning with respect to the opening in the fuel injector.

The fuel pipe may also be provided with a spring that cooperates with the pipe body to urge the first end of the pipe body away from the fuel injector. With such a configuration, the fuel pipe is easy to remove from the bore of the cylinder head.

An engine and fuel system combination is also provided under the invention. The combination comprises an engine including a cylinder head having a bore. The engine further includes a fuel injector connected to the cylinder head and having an opening. A fuel pipe is disposed in the bore of the cylinder head and includes a pipe body having first and second ends. The first end is engaged with the fuel injector such that the first end is aligned with the opening. The combination further includes a fuel line assembly including a fuel line having an end engaging the second end of the pipe body. The assembly also includes a rotatable nut engaged with the fuel line and threadingly engaged with the cylinder head so as to urge the end of the fuel line into engagement with the second end of the pipe body, to thereby urge the first end of the pipe body into engagement with the fuel injector.

These and other objects, features, and advantages of the present invention are readily apparent from the following detailed description of the best modes for carrying out the invention when taken in connection with the accompanying drawings.

BEST MODE FOR CARRYING OUT THE INVENTION

Figure 1:
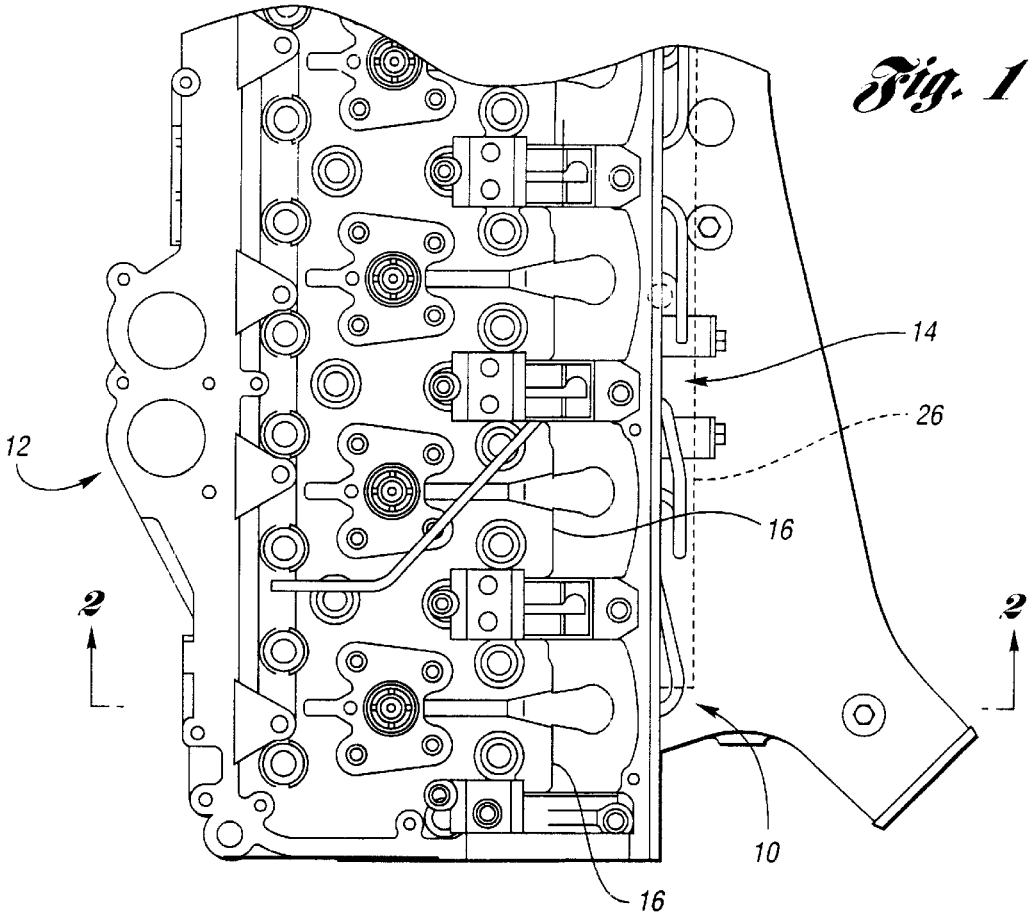
FIG. 1 is a top view of a fuel system according to the invention connected to an engine.
Figure 3:
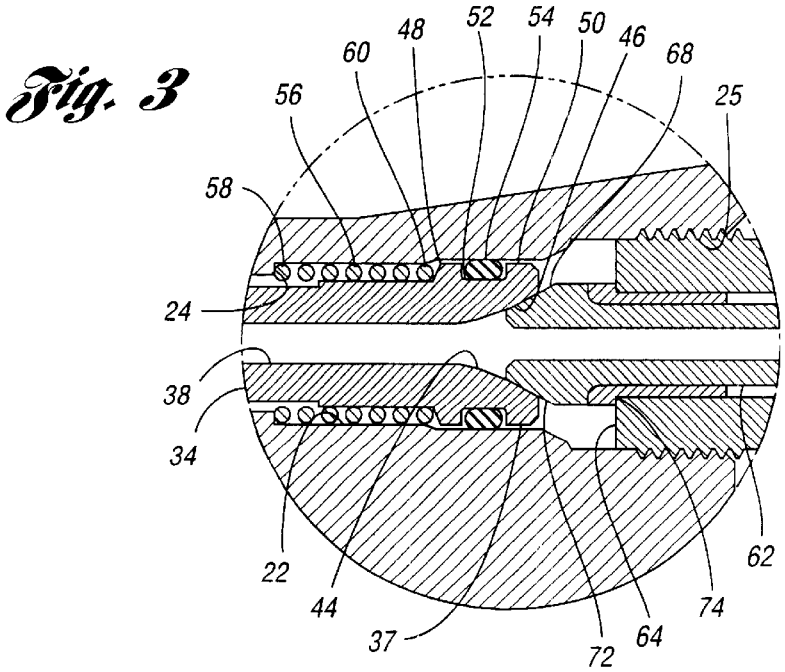
FIG. 3 is an enlarged view of a portion of the fuel system shown in FIG. 2.
Figure 2:
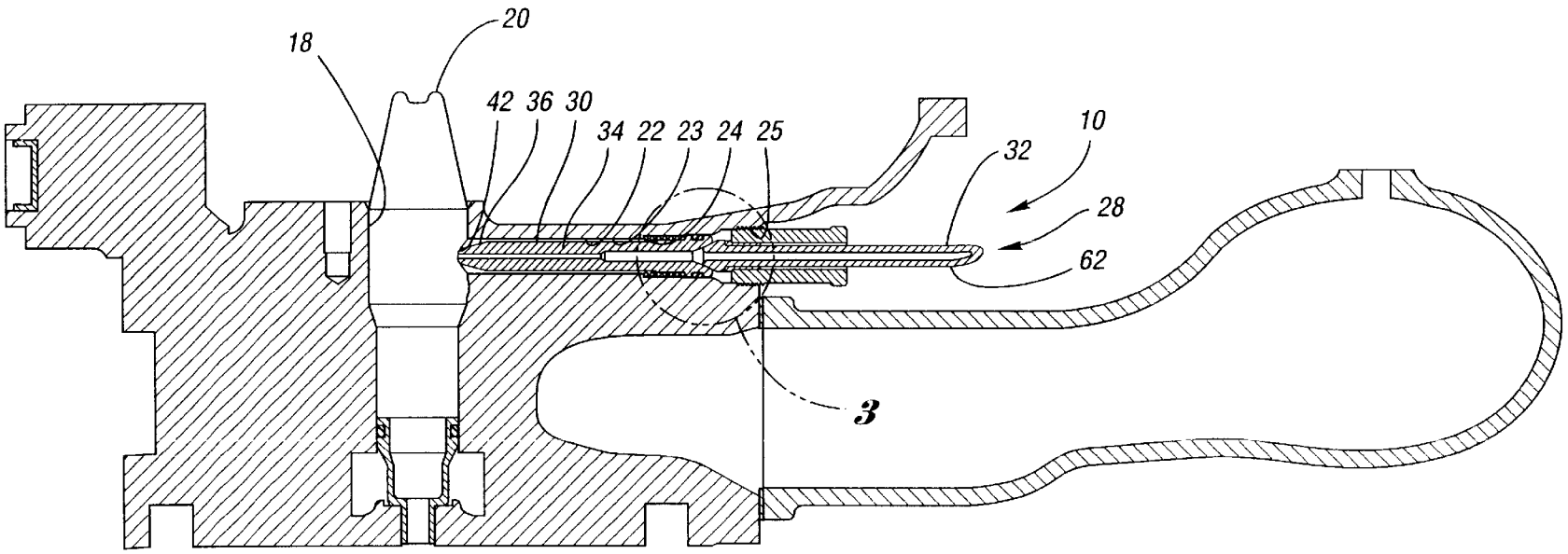
FIG. 2 is a cross-sectional view taken along line 2—2 of FIG. 1 and showing the fuel system engaged with a fuel injector of the engine.
Figure 4:
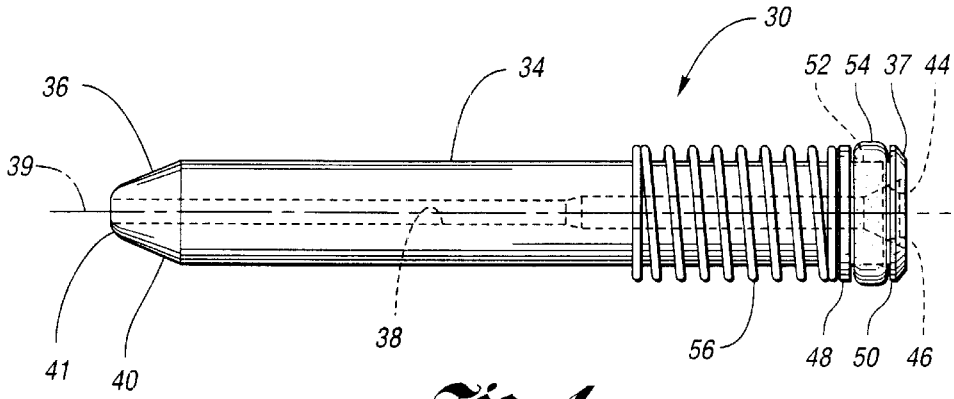
FIG. 4 is a side view of a fuel pipe of the fuel system.
Figure 5:
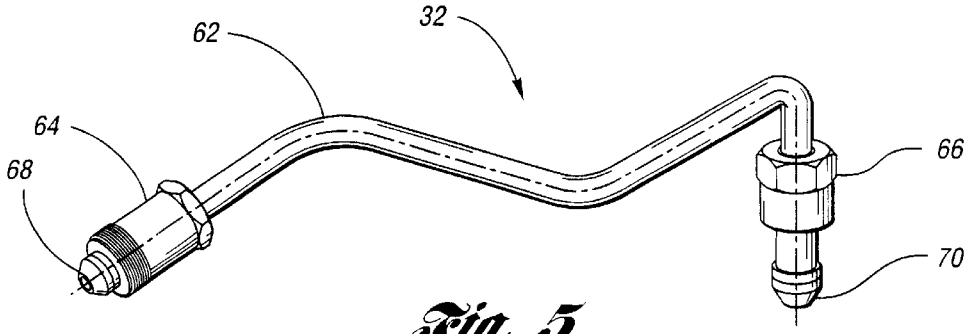
FIG. 5 is a perspective view of a fuel line assembly of the fuel system.

FIGS. 1 and 2 show a fuel system 10 according to the invention for supplying fuel, such as gasoline or diesel fuel, to an engine 12. The engine 12 includes a cylinder head assembly 14 having a plurality of cylinder heads 16. Each cylinder head 16 has an aperture 18 for receiving a fuel injector 20, and a bore 22 having a cylindrical portion 23, a shoulder 24 and a threaded portion 25.

The fuel system 10 is preferably designed to supply high pressure fuel to the engine 12. For example, the fuel system 10 may be used with operating pressures in the range of 20,000 to 26,000 pounds per square inch (psi). Furthermore, the fuel system 10 includes a common manifold or rail 26 and a plurality of fuel passage arrangements 28 extending between the common rail 26 and the fuel injectors 20.

Referring to FIGS. 2 through 5, each fuel passage arrangement 28 includes a fuel pipe 30 disposed in a bore 22 of a particular cylinder head 16, and a fuel line assembly 32 connected between the fuel pipe 30 and the rail 26 (only one fuel passage arrangement 28 is shown in FIG. 2). The fuel pipe 30 includes a pipe body 34 having first and second ends 36 and 37, respectively, a central passage 38, and an axis 39. The first end 36 has a frusto-conical portion 40 and a spherical portion 41 that is engaged with a particular fuel injector 20 such that the central passage 38 is aligned with an opening 42 in the fuel injector 20. Furthermore, the first end 36 forms a seal with the fuel injector 20. For example, the spherical portion 41 of the first end 36 preferably mates with a spherical surface that defines the opening 42. The second end 37 preferably has a radially-extending surface 44 that defines a tapered recess 46. For example, the recess 46 may have a frusto-conical shape.

The pipe body 34 preferably has a constant diameter along a major portion of the pipe body 34, and the diameter is selected so as to minimize clearance between the pipe body 34 and the cylindrical portion 23 of the bore 22. For example, the difference between the diameter of the pipe body 34 and the diameter of the cylindrical portion 23 is preferably in the range of 0.5 to 1.5 millimeters. With such a configuration, tilting of the pipe body 34 within the bore 22 is inhibited. As a result, the first end 36 of the pipe body 34 may be easily aligned with the opening in the fuel injector 20.

The pipe body 34 also has first and second flanges 48 and 50, respectively, that define a circumferential groove 52 for receiving a seal such as an O-ring 54. The O-ring 54 inhibits fuel from passing out of the bore 22.

Preferably, the pipe body 34 is configured to withstand pressures in excess of 26,000 psi. While the pipe body 34 may be made in any suitable manner and with any suitable material, in a preferred embodiment, the pipe body 34 comprises carbon steel.

The fuel pipe 30 further includes a spring 56 having first and second ends 58 and 60, respectively. The spring 56 cooperates with the pipe body 34 to urge the first end 36 of the pipe body 34 away from the fuel injector 20. Preferably, the first end 58 of the spring 56 is engaged with the shoulder 24 of the bore 22, and the second end 60 is engaged with the first flange 48.

The fuel line assembly 32 includes a fuel line 62 and first and second rotatable nuts 64 and 66, respectively. The fuel line 62 has first and second ends 68 and 70, respectively. The first end 68 has a tapered surface 72 that mates with the recess 46 to form a seal with the recess 46. For example, the tapered surface 72 may have a frusto-conical shape that mates with the recess 46. The first nut 64 engages a first shoulder 74 of the fuel line 62, and threadingly engages the bore 22 so as to urge the first end 68 of the fuel line 62 into engagement with the recess 46 of the pipe body 34 to thereby urge the first end 36 of the pipe body 34 into engagement with the fuel injector 20.

Figure 6:
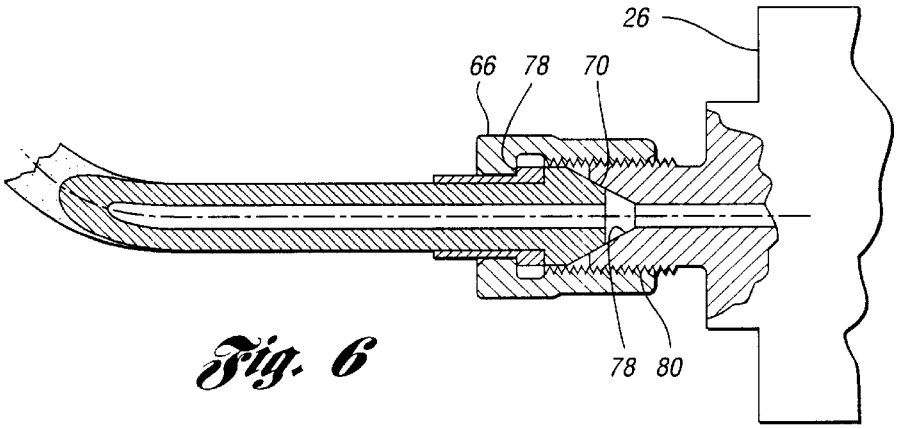
FIG. 6 is a fragmentary cross-sectional view of the fuel line assembly connected to a common rail of the fuel system.

Similarly, as shown in FIG. 6, the second end 70 preferably has a tapered surface that mates with a recess 76 in the rail 26. The second nut 66 engages a second shoulder 78 of the fuel line 62, and threadingly engages a surface 80 surrounding the recess 76 so as to urge the second end 70 of the fuel line 62 into engagement with the recess 76. Alternatively, the second end 70 may be connected to the rail 26 in any suitable manner.

The fuel line 62 is also preferably configured to withstand pressures in excess of 26,000 psi. While the fuel line 62 may be made in any suitable manner and with any suitable material, in a preferred embodiment, the fuel line 62 comprises high carbon steel.

To install the fuel system 10 on the engine 12, the fuel pipe 30 is first inserted into the bore 22 until the first end 58 of the spring 56 contacts the shoulder 24 of the bore 22. Next, the first end 68 of the fuel line 62 is positioned proximate the recess 46 of the fuel pipe 30 so that the first nut 64 may be engaged with the threaded portion 25 of the bore 22. The first nut 64 is then rotated in a first direction so as to threadingly engage the bore 22. As a result, the first nut 64 urges the first end 68 of the fuel line 62 into engagement with the recess 46 of the pipe body 34, and the fuel line 62 urges the first end 36 of the pipe body 34 into engagement with the fuel injector 20. Advantageously, the fuel line 62 applies a force on the pipe body 34 proximate the axis 39 of the pipe body 34. Therefore, undesirable tilting of the pipe body 34 is effectively eliminated. Furthermore, rotation of the first nut 64 in the first direction causes the spring 56 to compress.

Next, the second end 70 of the fuel line 62 is connected to the rail 26 such as with the second nut 66. Alternatively, the second end 70 may be connected to the rail 26 prior to connecting the first end 68.

Because the clearance between the pipe body 34 and the cylindrical portion 23 of the bore 22 is preferably minimized, the pipe body 34 may be self-aligning with respect to the opening 42 in the fuel injector 20. The spherical portion 41 of the first end 36 also aids in alignment of the pipe body 34 with respect to the opening 42.

Furthermore, because the fuel pipe 30 and the fuel line 32 are connected to each other and to the engine 12 with the first nut 64, the fuel system 10 provides a single torque connection to the engine 12. In addition, when the first nut 64 is rotated in a second direction opposite the first direction so as to disengage the first nut 64 from the bore 22, the spring 56 urges the pipe body 34 away from the fuel injector 20 so that the fuel pipe 30 may be easily removed from the bore 22.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A fuel system for supplying fuel to a fuel injector associated with a cylinder head, the fuel injector having an opening and the cylinder head having a bore, the system comprising:

a fuel pipe disposable in the bore of the cylinder head and including a pipe body having first and second ends, the first end being engageable with the fuel injector and alignable with the opening, the fuel pipe further including a spring that cooperates with the pipe body to urge the first end of the pipe body away from the fuel injector; and a fuel line assembly including a fuel line having an end that is engageable with the second end of the pipe body, the assembly further having a rotatable nut engageable with the fuel line and threadingly engageable with the cylinder head for urging the end of the fuel line into engagement with the second end of the pipe body to thereby urge the first end of the pipe body into engagement with the fuel injector.

2. The system of claim 1 wherein the second end of the pipe body has a radially-extending surface, and the end of the fuel line is engageable with the radially-extending surface so as to urge the first end of the pipe body into engagement with the fuel injector.

3. The system of claim 1 wherein the second end of the pipe body has a recess, and the end of the fuel line is engageable with the recess so as to urge the first end of the pipe body into engagement with the fuel injector.

4. The system of claim I wherein the pipe body has a constant diameter along a major portion of the pipe body.

5. The system of claim I wherein the pipe body has a flange, and the spring has first and second ends, the first end of the spring being engageable with a surface of the bore, and the second end of the spring being engageable with the flange.

6. An engine and fuel system combination comprising:

an engine including a cylinder head having a bore, and a fuel injector connected to the cylinder head and having an opening;

a fuel pipe disposed in the bore of the cylinder head and including a pipe body having first and second ends, the first end engaging the fuel injector such that the first end is aligned with the opening, the fuel pipe further including a spring that cooperates with the pipe body to urge the first end of the pipe body away from the opening of the fuel injector; and a fuel line assembly including a fuel line having an end engaging the second end of the pipe body, the assembly further having a rotatable nut engaging the fuel line and threadingly engaging the cylinder head so as to urge the end of the fuel line into engagement with the second end of the pipe body to thereby urge the first end of the pipe body into engagement with the fuel injector.

7. The combination of claim 6 wherein the second end of the pipe body has a radially-extending surface, and the end of the fuel line is engaged with the radially-extending surface so as to urge the first end of the pipe body into engagement with the fuel injector.

8. The combination of claim 6 wherein the second end of the pipe body has a recess, and the end of the fuel line is engaged with the recess so as to urge the first end of the pipe body into engagement with the fuel injector.

9. The combination of claim 6 wherein the pipe body has a constant diameter along a major portion of the pipe body.

10. The combination of claim 6 wherein the bore has a shoulder, the pipe body has a flange, and the spring has first and second ends, the first end of the spring engaging the shoulder, and the second end of the spring engaging the flange.

11. The combination of claim 6 wherein the bore has a cylindrical portion having a first diameter, and the pipe body has a second diameter that is in the range of 0.5 to 1.5 millimeters less than the first diameter.

12. An engine and fuel system combination comprising:

an engine including a cylinder head and a fuel injector connected to the cylinder head, the cylinder head including a bore having a shoulder, the fuel injector having an opening;

a fuel pipe installed in the bore of the cylinder head and including a pipe body having first and second ends and a flange, the first end of the pipe body engaging the fuel injector so that the first end is aligned with the opening, the second end having a recess, the fuel pipe further including a spring disposed between the shoulder and the flange for urging the first end of the pipe body away from the fuel injector; and a fuel line assembly including a fuel line having an end engaging the recess, the assembly further having a rotatable nut engaging the fuel line and threadingly engaging the cylinder head so as to urge the end of the fuel line into engagement with the recess to thereby urge the first end of the pipe body into engagement with the fuel injector.

13. An engine and fuel system combination comprising:

an engine including a cylinder head having a bore, and a fuel injector connected to the cylinder head and having an opening, the bore including a cylindrical portion having a first diameter;

a fuel pipe disposed in the bore of the cylinder head and including a pipe body having first and second ends, the first end engaging the fuel injector such that the first end is aligned with the opening, the pipe body having a constant second diameter along a major portion of the pipe body, the second diameter being in the range of 0.5 to 1.5 millimeters less than the first diameter; and a fuel line assembly including a fuel line having an end engaging the second end of the pipe body, the assembly further having a rotatable nut engaging the fuel line and threadingly engaging the cylinder head so as to urge the end of the fuel line into engagement with the second end of the pipe body to thereby urge the first end of the pipe body into engagement with the fuel injector.

* * * * *